US005107301A

United States Patent [19]

Yamauchi

[11] Patent Number: 5,107,301

[45] Date of Patent: Apr. 21, 1992

[54] IMAGE FORMING APPARATUS HAVING AN AUTOMATIC TONER SUPPLIER

[75] Inventor: Shin Yamauchi, Tokyo, Japan

[73] Assignee: Kabushiki Kaisha Toshiba, Kawasaki, Japan

[21] Appl. No.: 315,149

[22] Filed: Feb. 24, 1989

[30] Foreign Application Priority Data

Mar. 4, 1988 [JP] Japan ..... 63-50903

[51] Int. Cl.[5] ..... G03G 21/00

[52] U.S. Cl. ..... 355/208; 355/246

[58] Field of Search ..... 355/206, 208, 209, 246

[56] References Cited

U.S. PATENT DOCUMENTS

| | | | |
|---|---|---|---|
| 4,310,238 | 1/1982 | Mochizuki et al. | 355/246 |
| 4,592,645 | 6/1986 | Kanai et al. | 355/206 |
| 4,901,115 | 2/1990 | Nakamura et al. | 355/246 |
| 4,916,488 | 4/1990 | Kimura | 355/208 |
| 4,932,356 | 6/1990 | Watanabe et al. | 355/208 X |
| 4,975,742 | 12/1990 | Tada et al. | 355/208 |

FOREIGN PATENT DOCUMENTS

| | | |
|---|---|---|
| 0029584 | 6/1981 | European Pat. Off. . |
| 0112450 | 7/1984 | European Pat. Off. . |
| 3800248 | 7/1988 | Fed. Rep. of Germany . |

*Primary Examiner*—Fred L. Braun
*Attorney, Agent, or Firm*—Foley & Lardner

[57] ABSTRACT

An image forming apparatus includes an automatic toner supplier for detecting a toner density using a toner sensor and automatically supplying a toner when the toner density is decreased. The toner sensor is automatically initialized when initial use of the image forming apparatus is started so as to generate an analog voltage signal having a predetermined level corresponding to a reference toner density. That is, an output voltage from the toner sensor is converted into a digital signal by an analog/digital (A/D) converter. A comparator compares this digital signal with a reference voltage corresponding to the reference toner density. An arithmetic-logic unit adds/subtracts a digital adjustment value in accordance with a comparison result from the comparator. This adjustment value is converted by a digital-/analog (D/A) converter into an analog control voltage signal and is applied to the toner sensor. That is, the control voltages are converged by a loop including the toner sensor, the A/D converter, the comparator, the arithmetic-logic unit, and the D/A converter so as to set the output voltage signal from the toner sensor at the predetermined level corresponding to the reference toner density.

14 Claims, 12 Drawing Sheets

IMAGE FORMING APPARATUS HAVING AN AUTOMATIC TONER SUPPLIER

BACKGROUND OF THE INVENTION

1. Field of the Invention

The present invention relates to an image forming apparatus such as an electronic copying machine in which toner consumed through the forming of an image is supplied automatically.

2. Description of the Related Art

As is known, some electronic copying machines having a developing unit for developing a latent image by use of a developing agent which is a mixture of a magnetic carrier and a nonmagnetic toner comprise an automatic toner supplier which maintains the toner at a constant density in order for consistently high-quality images to be obtained every time the machine is operated.

In such an automatic toner supplier, the permeability of the developing agent in a developing unit is monitored by a toner sensor. When the toner density decreases and the sensor detects that the permeability exceeds a reference value, a control section drives a toner supply motor, to supply additional toner from a toner cartridge to the developing unit. Such an operation continues until the permeability again becomes lower than the reference value level. In the event that the toner density is not restored within a predetermined time period after the toner density has dropped below the reference value level, the control section determines that the supply of toner in the toner cartridge has been used up (toner empty), whereupon it causes a display section to indicate the need for toner replenishment (toner supply) and stops copying from being performed.

The toner sensor detects the toner density from the reactance of the developing agent which varies in accordance with the mixing ratio of the carrier to the toner. The toner sensor has one magnetic member and two magnetic transformers. Each transformer is comprised of a core and multi-turn coils wound around the core. The first transformer (detection side transformer) is located in contact with the developing agent. The magnetic member is located near the second transformer such that it causes the second transformer (reference side transformer) to generate an electromotive force which corresponds to the reference value of the toner density. When the toner density, i.e., the reactance of the developing agnet, changes, the permeability of the core of the first transformer also changes, thus causing a change in the electromotive force induced by the second transformer. The toner sensor is designed to output an analog voltage corresponding to a difference between the electromotive forces of the detection and reference side transformers. With this arrangement, the control section can determine the current toner density with respect to the reference toner density in accordance with the value of analog output voltage from this toner sensor.

When the toner density is controlled by means of such a toner sensor, the analog output voltage from the toner sensor must be initialized to a reference voltage corresponding to the reference toner density of a developing agent. In a conventional automatic toner supplier, this output voltage is adjusted by way of the operator manipulating a volume control knob or the like to alter the position of a magnetic member arranged near the core of a reference side transformer and thereby change the permeability of the core. Not only is this adjustment method cumbersome, but it is also very time-consuming.

SUMMARY OF THE INVENTION

The present invention has developed in consideration of the above situation and has as its object to provide an image forming apparatus which can automatically set the output from a toner sensor to a reference voltage corresponding to a reference toner density of a developing agent, so as to release an operator from a cumbersome operation of operativg a volume or the like, and to shorten the time required for adjustment.

According to the present invention, there is provided an image forming apparatus comprising means for storing a developing agent which is a mixture of a toner and a carrier, means for transferring the toner in the developing agent stored in the storing means onto a transfer medium to form an image on the transfer medium, means for detecting the density of the toner in the developing agent stored in the storing means, the detecting means generating an output signal having a level corresponding to the toner density, and including changing means for changing the level of the output signal in proportion to a level of a control signal applied thereto, and initializing means for automatically initializing the output signal from the detecting means by applying the control signal to the changing means of the detecting means, the initializing mean including means for converging the control signal on a level such that the output signal from the detecting means is set at a reference level corresponding to a level during periods when the toner density has a reference value, by increasing/decreasing repeatedly the level of the control signal in accordance with the level of the output signal from the detecting means.

DETAILED DESCRIPTION OF THE PREFERRED EMBODIMENT

An embodiment of the present invention will be described below with reference to the accompanying drawings.

Figure 1:
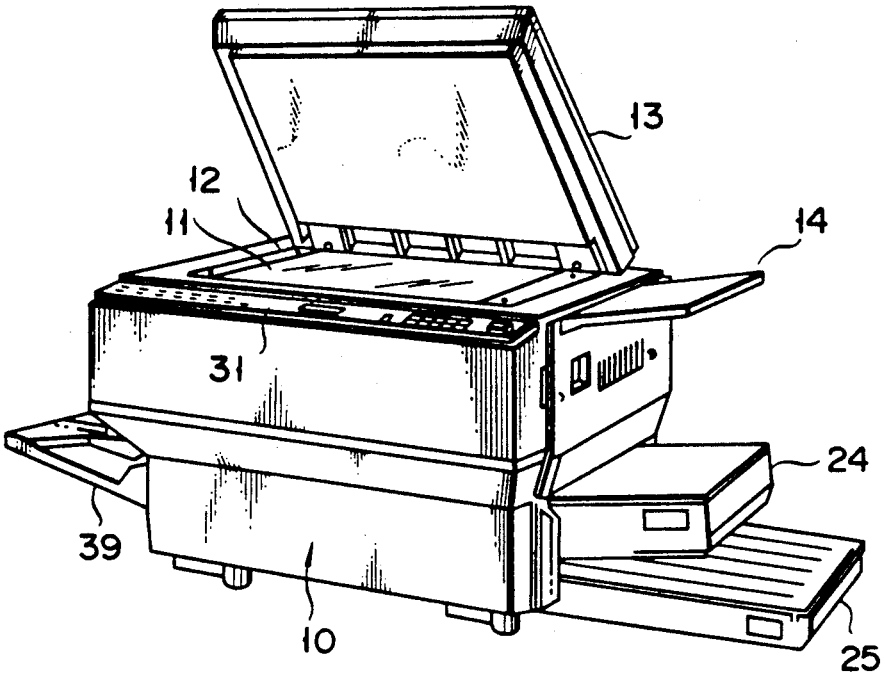
FIG. 1 is a perspective view showing an outer appearance of an image forming apparatus according to the present invention.
Figure 2:
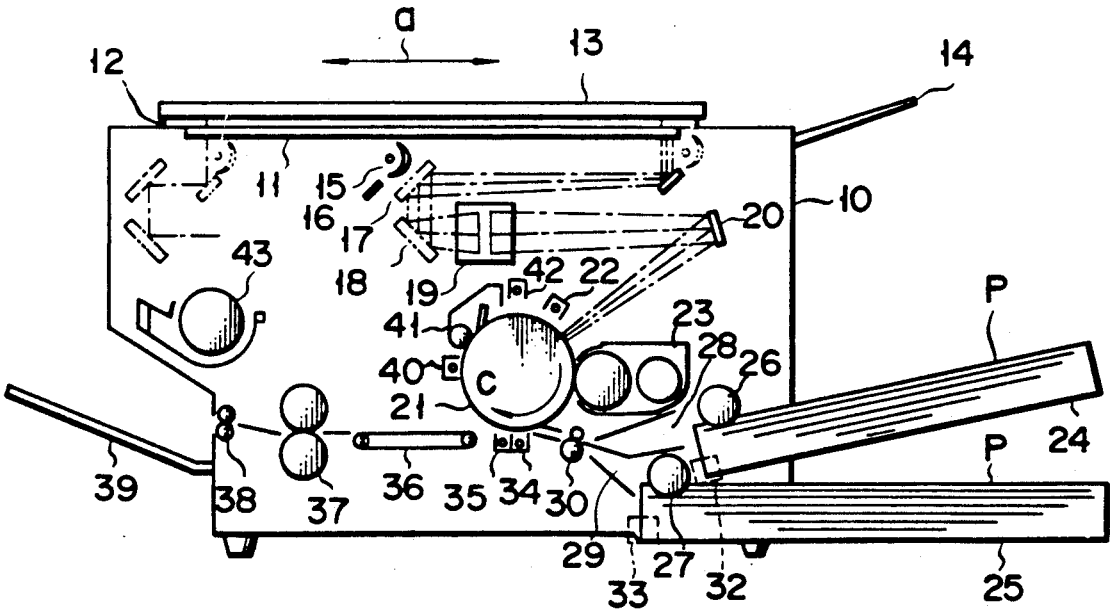
FIG. 2 is a side sectional view showing the image forming apparatus in FIG. 1.

FIGS. 1 and 2 schematically show an image forming apparatus, e.g., a copying machine, according to the present invention. More specifically, document table (transparent glass) 11 for placing a document thereon is fixed on the upper surface of main body 10 of a copying machine. Stationary scale 12 serving as a reference for setting a document is arranged on document table 11. Openable cover 13 and work table 14 are arranged near document table 11. A document placed on document table 11 is exposed/scanned by reciprocating an optical system including discharge lamp 15 and mirrors 16, 17, and 18 along the lower surface of document table 11 in a direction indicated by arrow a in FIG. 2. In this case, mirrors 17 and 18 are moved at a speed ½ that of mirror 16 so as to maintain an optical path length. Light reflected by the document upon exposure/scanning by the optical system, i.e., light reflected by the document upon radiation by discharge lamp 15, is reflected by mirrors 16, 17, and 18. Subsequently, the light propagates through magnification change lens block 19, and is further reflected by mirror 20 to be guided to photosensitive drum 21, thereby forming the image of the document on the surface of photosensitive drum 21.

Photosensitive drum 21 is rotated in a direction indicated by arrow c in FIG. 2, so that its surface is charged by charger 22. Thereafter, the image is subjected to slit exposure to form an electrostatic latent image on the surface of drum 21. This electrostatic latent image is visualized upon application of a toner by developing unit 23.

Sheets of paper (transfer media) P are picked up one by one by feed roller 26 or 27 from selected upper or lower feed cassette 24 or 25. The picked-up paper is guided to registration roller pair 30 through paper guide path 28 or 29 and is conveyed to a transfer section by roller pair 30.

In this case, feed cassettes 24 and 25 are detachably arranged in a lower right end portion of main body 10. One of the cassettes can be selected by operation panel 31. Note that the sizes of cassettes 24 and 25 are detected by detection switches 32 and 33, respectively. Each of detection switches 32 and 33 is constituted by a plurality of microswitches which are turned ON/OFF in accordance with insertion of cassettes having different sizes.

Paper P conveyed to the transfer section is brought into tight contact with the surface of photosensitive drum 21 at the position of transfer charger 34. The toner image on photosensitive drum 21 is transferred onto paper P upon operation of charger 34. Paper P on which the image is transferred is electrostatically separated from photosensitive drum 21 upon operation of separation charger 35, and is conveyed by conveyor belt 36 to fixing roller pair 37 as a fixing unit arranged at an end portion of belt 36. When paper P passes through roller pair 37, the transferred image is fixed. Upon the fixing process, paper P is discharged by discharge roller pair 38 into discharge tray 39 outside main body 10.

Upon the transfer process, photosensitive drum 21 is discharged by discharge charger 40. Then, the residual toner on the surface of drum 21 is removed by cleaner 41. Furthermore, the residual image is erased by discharge lamp 42, and drum 21 is restored to the initial state. Note that reference numeral 43 in FIG. 2 denotes a cooling fan for preventing a rise in temperature in main body 1.

Figure 3:
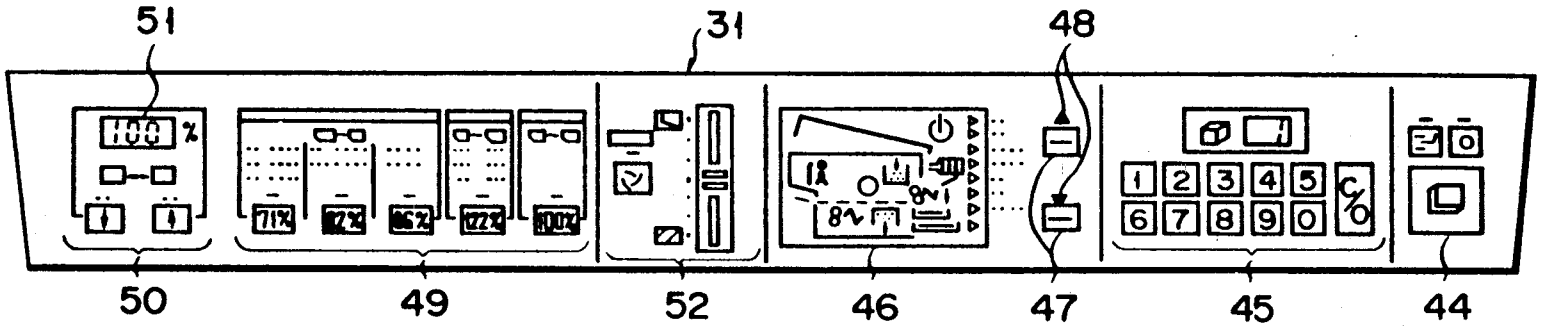
FIG. 3 is a plan view showing an arrangement of an operation panel.

FIG. 3 shows operation panel 31 arranged in main body 10. Operation panel 31 comprises copy key 44 for designating the start of copying, ten-key pad 45 for setting the number of copies and the like, display section 46 for displaying an operation state of each part or a jam of paper, cassette selection key 47 for selecting upper or lower feed cassette 24 or 25, cassette display section 48 for displaying a selected cassette, magnification setting key 49 for setting enlargement and reduction magnifications of copying in a predetermined relationship, zoom key 50 for setting enlargement and reduction magnifications without steps, magnification display section 51 for displaying a selected magnification, and density setting section 52 for setting a copy density.

Figure 4:
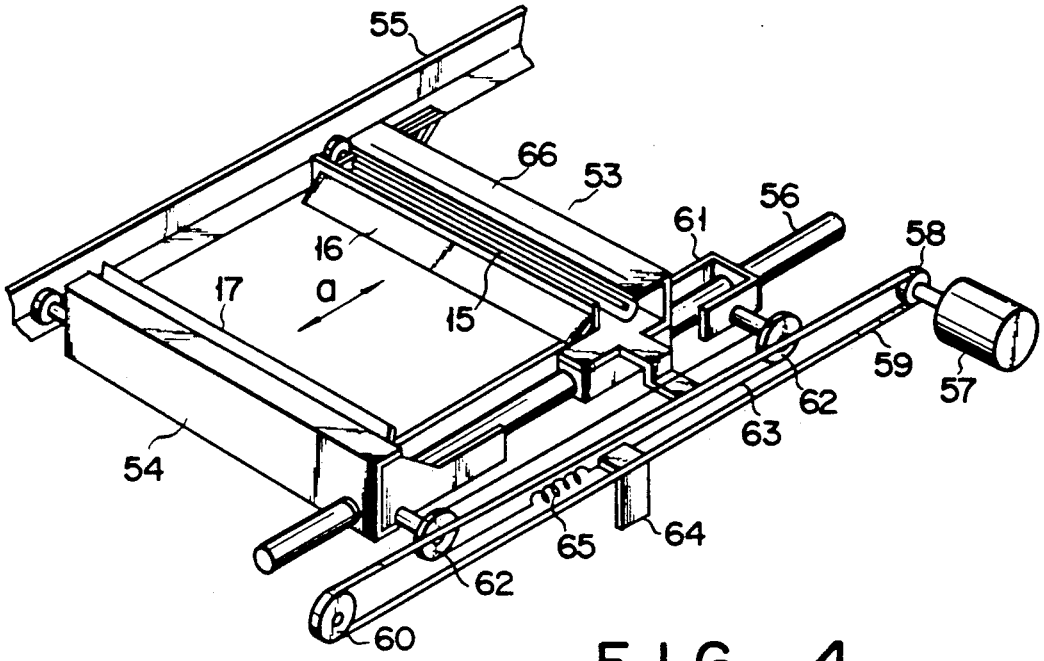
FIG. 4 is a schematic perspective view showing an optical system of a driving mechanism.

FIG. 4 shows a driving mechanism for reciprocating the optical system. More specifically, mirror 16 and discharge lamp 15 are supported by first carriage 53, whereas mirrors 17 and 18 are supported by second carriage 54. First and second carriages 53 and 54 are guided by guide rails 55 and 56 so as to be freely moved parallel to each other in a direction indicated by arrow a. Four-phase pulse motor 57 drives pulley 58. Endless belt 59 is looped around pulley 58 and idle pulley 60. One end of first carriage 53 which supports mirror 16 is fixed to an intermediate portion of belt 59.

Two pulleys 62 are rotatably arranged on guide portion 61 of second carriage 54 so as to be separated from each other in the axial direction of rail 56. Wire 63 is looped around pulleys 62. One end of wire 63 is fixed to stationary portion 64, and the other end of wire 63 is fixed thereto through coil spring 65. One end of first carriage 53 is fixed to an intermediate portion of wire 63. With this arrangement, when pulse motor 57 is rotated, belt 59 is rotated, and first carriage 53 is moved. Upon this rotation, second carriage 54 is moved. In this case, since pulleys 62 serve as movable pulleys, second carriage 54 is moved at a speed ½ that of first carriage 53 in the same direction. Note that the directions of first and second carriages 53 and 54 are controlled by switching the rotational direction of pulse motor 57.

A copy range for designated paper P is displayed on document table 11. More specifically, if a paper size designated by cassette selection key 47 is size (Px, Py), and a copy magnification designated by magnification setting key 49 or 50 is K, copy range (x, y) is range ($x=Px/K$, $y=Py/K$). In copy range (x, y), an x-direction length is displayed as a distance between two pointers (not shown) arranged on the lower surface of document table 11, and a y-direction length is displayed as a distance from scale 66 arranged on the upper surface of first carriage 53 to stationary scale 12.

Figure 5:
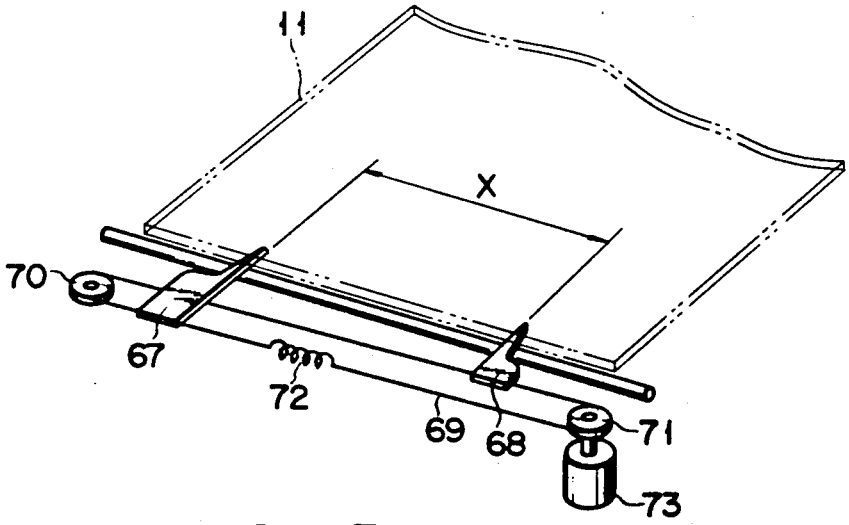
FIG. 5 is a schematic perspective view showing a driving mechanism of pointers.

FIG. 5 shows a moving mechanism for two pointers. More specifically, pointers 67 and 68 are arranged on wire 69 looped around pulleys 70 and 71 through spring 72. Pulley 71 is rotated by motor 73. The distance between pointers 67 and 68 can be changed by driving motor 73 in accordance with the previously obtained copy range in the x-direction.

First carriage 53 is moved to a predetermined position (a home position corresponding to a magnification)

by driving motor 57 in accordance with the paper size and the copy magnification. When copy key 44 is operated, first carriage 53 is moved toward second carriage 54. Subsequently, discharge lamp 15 is turned on, and first carriage 53 is moved in a direction to be separated from second carriage 54. When scanning of the document is completed in this manner, discharge lamp 15 is turned off, and first carriage 53 is returned to the home position.

Figure 6:
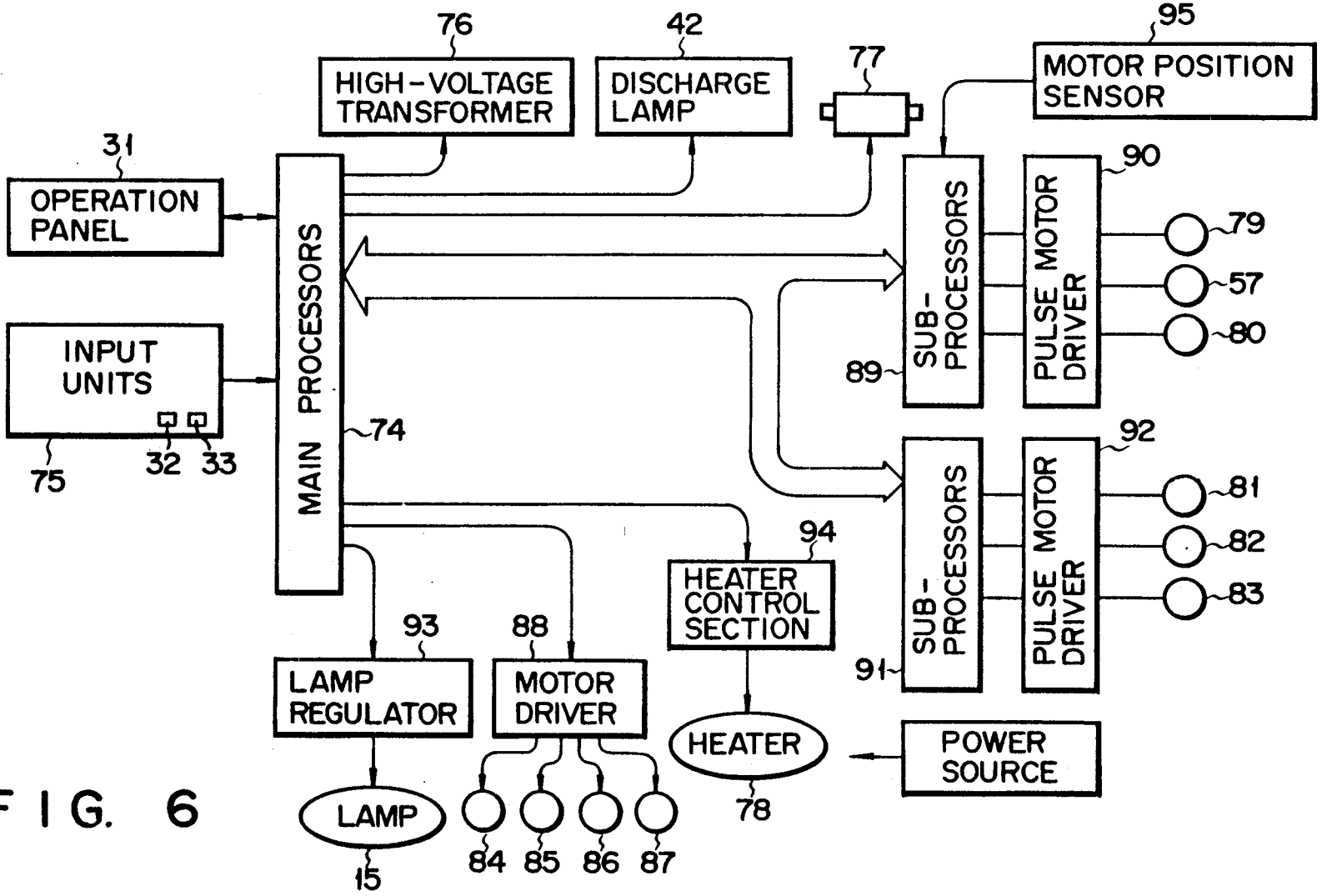
FIG. 6 is a block diagram showing an arrangement of a control system.

FIG. 6 shows an overall control circuit. Main processors 74 receive signals from operation panel 31 and input unit 75 including various switches and sensors, e.g., cassette size detection switches 32 and 33, a toner sensor (to be described later), and the like. In accordance with these input signals, main processors 74 control high-voltage transformer 76 for driving the respective chargers, discharge lamp 42, blade solenoid (BLD) 77 of cleaner 41, heater 78 of fixing roller pair 37, exposure lamp 15, motors 57, and 79 to 87 so as to perform the above-described copy operation.

Of motors 57, and 79 to 87, motors 84 to 87 are controlled by main processors 74 through motor driver 88. Motors 57, 79, and 80 are controlled by first subprocessors 89 through pulse driver 90. Motors 81 to 83 are controlled by second subprocessors 91 through pulse motor driver 92.

In this case, driving motor 57 is a scanning motor for moving exposure lamp 15, and mirrors 16, 17, and 18 so as to scan a document. Motor 79 is a lens motor for moving the position of magnification change lens block 19 so as to change a magnification. Motor 80 is a shutter motor for moving a shutter (not shown) so as to adjust a width of charging which is performed by charger 22 with respect to photosensitive drum 21 when a magnification is changed. Motor 81 is a drum motor for driving photosensitive drum 21. Motor 82 is a paper feed motor for driving feed rollers 26 and 27. Motor 83 is a convey motor for driving registration roller pair 30. Motor 84 is a toner motor for supplying a toner to developing unit 23. Motor 85 is a fan motor for driving cooling fan 43. Motor 86 is a developing motor for driving a developing roller (sleeve). Motor 87 is a fixing motor for driving conveyor belt 36, fixing roller pair 37, and discharge roller pair 38.

Exposure lamp 15 is controlled by main processors 74 through lamp regulator 93. Heater 78 is controlled by main processors 74 through heater control section 94. Main processors 74 supply drive/stop commands for the respective motors to first and second subprocessors 89 and 91. First and second subprocessors 89 and 91 supply status signals representing drive/stop states of the motors to main processors 74. First subprocessors 89 receive position data from motor position sensor 95 for detecting the initial position of each motor 57, 79, or 80. First and second subprocessors 89 and 91 are constituted by, e.g., microcomputers, programmable interval timers for controlling the phase switching time intervals of the pulse motors by counting reference clock pulses from the microcomputers, and the like.

Figure 7:
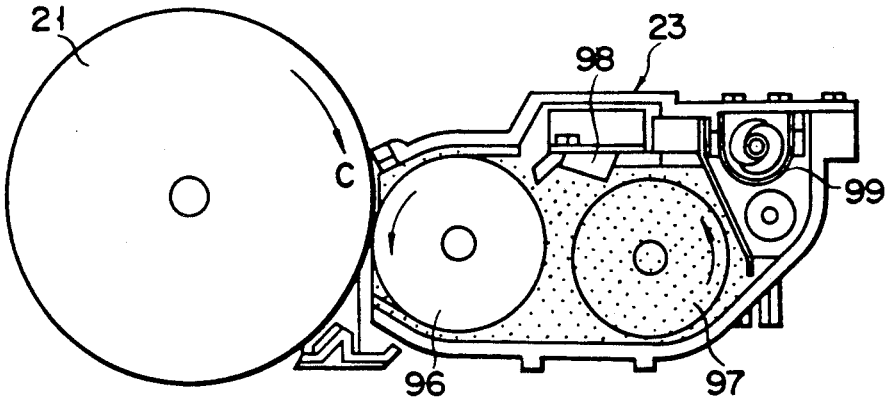
FIG. 7 is a partial view showing a photosensitive drum and a developing unit.

FIG. 7 shows a part of photosensitive drum 21 and developing unit 23. Developing unit 23 develops the latent image on photosensitive drum 21 by rotating sleeve 96 in a direction opposite to photosensitive drum 21 as indicated by an arrow in FIG. 7. Developing unit 23 uses a mixture of a magnetic carrier and a non-magnetic toner as a developing agent.

Figure 8:
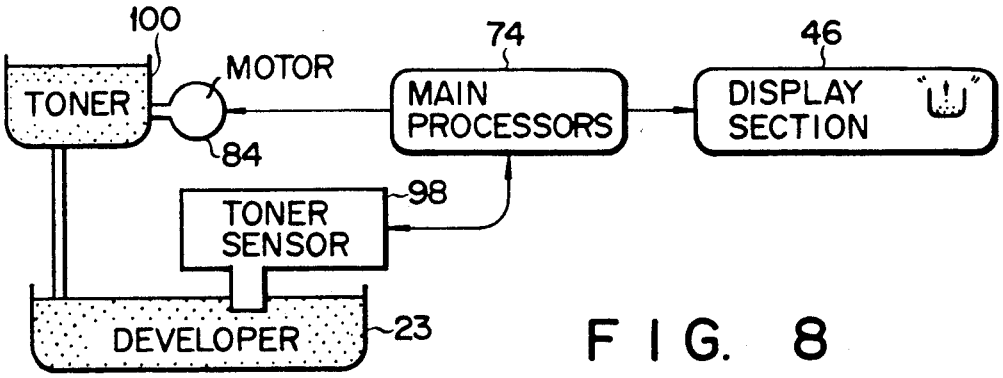
FIG. 8 is a schematic view showing an arrangement of an automatic toner supplier.

An automatic toner supplier shown in FIG. 8 is arranged in developing unit 23 so as to always keep the toner density of the developing agent to be a proper density. More specifically, the developing agent in developing unit 23 is fully agitated by mixer 97, and the toner density in the developing agent is detected by toner sensor 98 in this state. When a decrease in toner density is detected by toner sensor 98, toner motor 84 is driven, and a toner in toner cartridge 100 is supplied through toner convey port 99. In this case, sensor 98 monitors the permeability of a developing agent flowing along its surface, and reads a change in permeability due to consumption of the toner. An output from sensor 98 is supplied to main processors 74, and is compared with the reference voltage corresponding to the reference toner density. In this case, when the output from sensor 98 is higher than the reference voltage (lower than the reference density), main processors 74 rotate toner motor 84 through motor driver 88 until the output from toner sensor 98 becomes lower than the reference voltage, thereby supplying a toner in developing unit 23.

Figure 9:
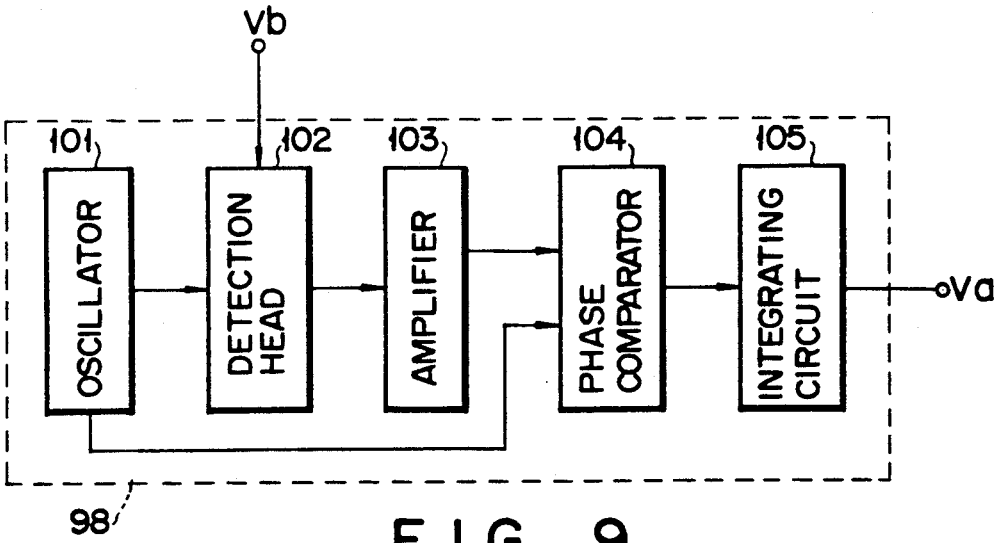
FIG. 9 is a block diagram showing an arrangement of a toner sensor.

Toner sensor 98 described above comprises, for example, as is shown in FIG. 9, oscillator 101, detection head 102, amplifier 103, phase comparator 104, and integrating circuit 105. Detection head 102 is designed such that two magnetic transformers each having two identical multiturn coils wound around a single core are used and one of them is placed in a developing agent. An output corresponding to a difference between outputs from both the transformers is supplied to amplifier 103. In addition, an output voltage from detection head 102 is changed in accordance with externally supplied control voltage Vb. Detection head 102 is initialized so as to obtain a differential output in accordance with the reference toner density of a developing agent. That is, by adjusting control voltage Vb, output voltage Va from toner sensor 98 is initialized to be a predetermined value. After this initialization, main processors 74 control toner supply motor 84 in accordance with a comparison result between output Va from toner sensor 98 and a predetermined reference value.

Figure 10:
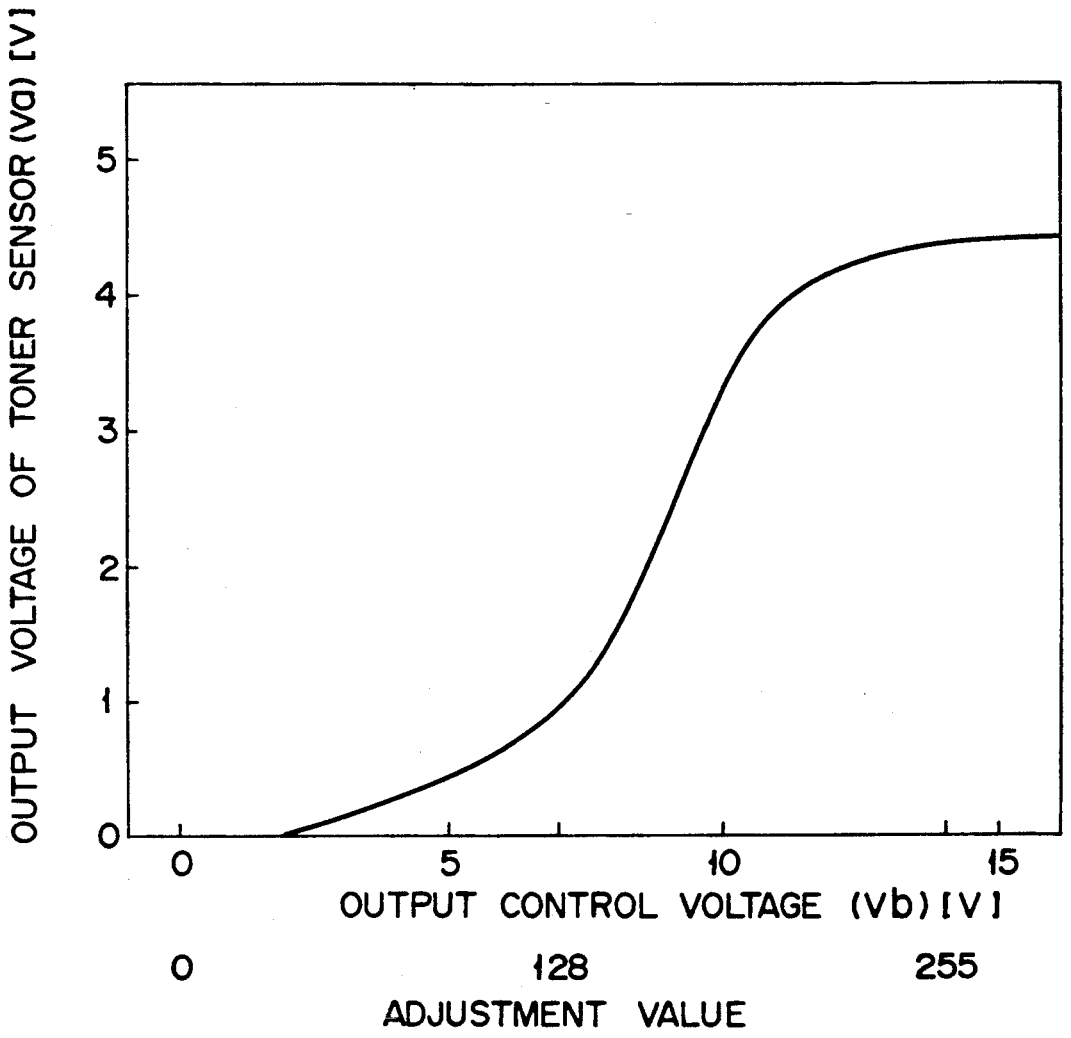
FIG. 10 is a graph showing a characteristic of the toner sensor.

FIG. 10 is a graph showing a characteristic of toner sensor 98, i.e., a relationship between control voltage Vb and output voltage Va. As is apparent from FIG. 10, the output from toner sensor 98 can be changed by changing control voltage Vb. Output voltage Va from toner sensor 98 having such an arrangement can be automatically changed by digitally changing control voltage Vo using a microcomputer and the like, and can be automatically initialized to the reference voltage corresponding to the reference toner density. More specifically, a control width of control voltage Vb is divided into a plurality of units, e.g., 256 units between 0 to 14 volt. Voltage values corresponding to the characteristic of a sensor are assigned to the respective digital values corresponding to the divided units from 0 to 255, thereby setting an adjustment value. Control voltage Vb is controlled by the microcomputer or the like using this adjustment value so as to digitally change output voltage Va from toner sensor 98.

Figure 11:
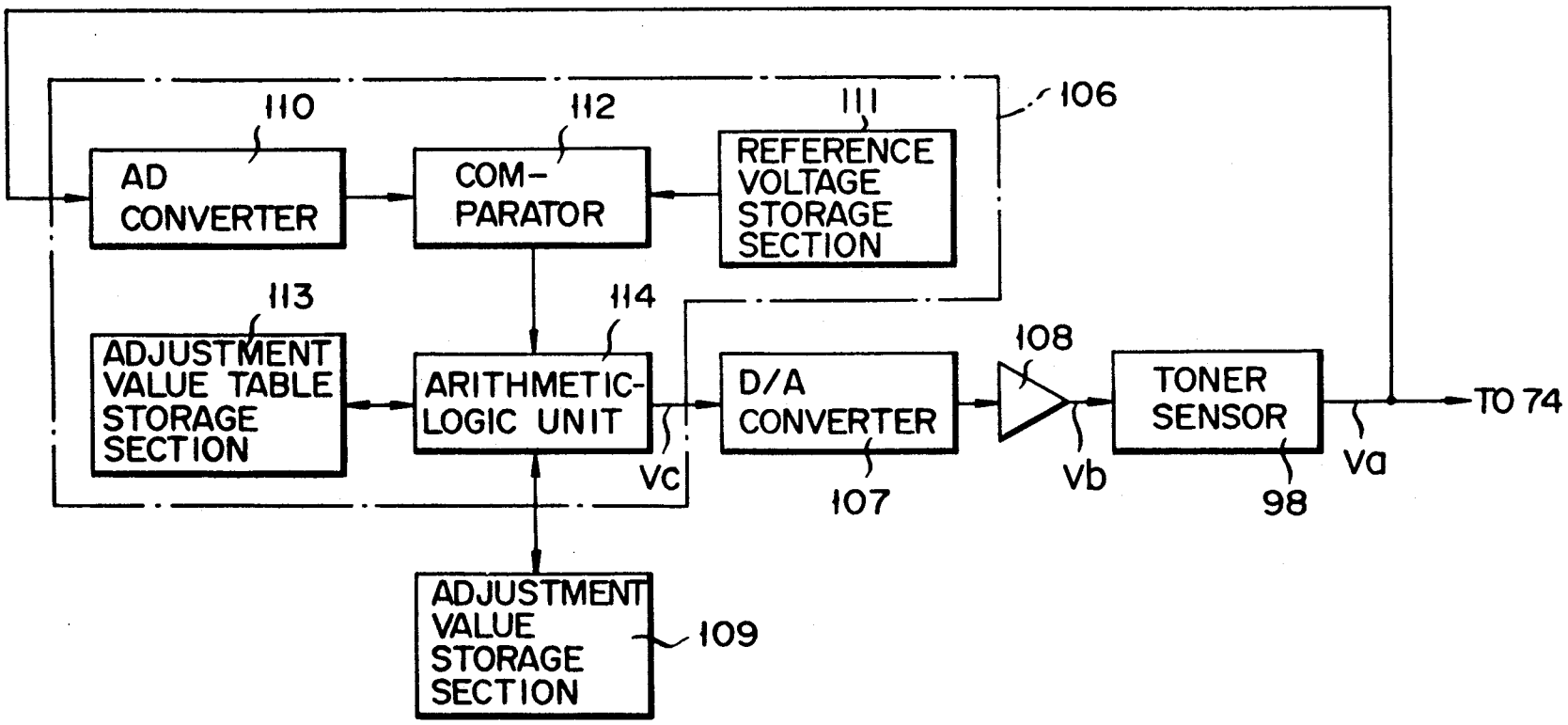
FIG. 11 is a block diagram showing an arrangement of a control circuit for adjusting the output from the toner sensor.

FIG. 11 shows an automatic setting circuit for automatically initializing an analog output voltage from toner sensor 98. The automatic setting circuit comprises control circuit 106, D/A converter 107, and amplifier 108. After control circuit 106 converts output voltage (analog output voltage) Va from toner sensor 98 into a digital signal, it compares the signal with the reference voltage corresponding t the reference toner density in the developing agent. Control circuit 106 determines adjustment value Vc on the basis of this comparison result, and causes adjustment value storage section 109 to store adjustment value Vc. D/A converter 107 generates control voltage Vb corresponding to the digital value of adjustment value Vc from control circuit 106. Amplifier 108 applies control voltage Vb from D/A converter 107 to toner sensor 98.

Control circuit 106 comprises A/D converter 110, reference voltage storage section 111, comparator 112, adjustment table storage section 113, and arithmetic-logic unit (ALU) 114. A/D converter 110 receives output voltage Va from toner sensor 98 and converts it into a digital signal. Reference voltage storage section 111 stores a reference voltage value corresponding to the reference toner density of a developing agent. The digital signal from A/D converter and the reference voltage value stored in the reference voltage storage section 111 are supplied to comparator 112. Comparator 112 compares the digital signal with the reference voltage valve. A comparison result obtained by comparator 112 is supplied to ALU 114. Adjustment value table storage section 113 stores digital values (0 to 255) corresponding to voltage values when control voltage Vb is divided in accordance with the characteristics of toner sensor 98, e.g., control voltage Vb ranging from 0 to 14 volt is divided into 256 units. ALU 114 determines adjustment value Vc on the basis of the comparison result supplied from comparator 112 by referring to adjustment value table storage section 113.

That is, control voltage Vb is digitally changed by changing adjustment value (digital value). Note that the control width of control voltage Vb is divided in accordance with the characteristics of toner sensor 98 such that at least one digital value corresponds to a value within the allowable range of the reference voltage. With this arrangement, outputs from toner sensor 98 can be converged on the reference voltage with high precision.

ALU 114 sets a certain adjustment value (fundamental adjustment value) when it is detected upon comparison by comparator 112 that output voltage Va falls outside the allowable range of the reference voltage. Output value Va when this fundamental adjustment value is set is compared with the reference value in comparator 112. When it is determined upon comparison that output voltage Va with respect to the fundamental adjustment value is lower than the allowable range of the reference voltage, an adjustment value ½ of the fundamental adjustment value is added to the fundamental adjustment value. When output voltage Va with respect to the fundamental adjustment value exceeds the allowable range of the reference voltage, an adjustment value ½ of the fundamental adjustment value is subtracted from the fundamental adjustment value, thereby determining a new (first) adjustment value. The fundamental adjustment value which has been reduced to half is further reduced to half (¼) and the reduced value is added/subtracted to/from the first adjustment value to determined a new (second) adjustment value depending on whether output value Va from sensor 98 with respect to the determined first adjustment value is lower or higher than the allowable range of the reference value. This operation (binary search) is repeated until output voltage Va from sensor 98 falls within the allowable range of the reference voltage so as to converge output voltages Va from sensor 98 on the allowable range of the reference voltage corresponding to the reference toner density of the developing agent. Thereafter, adjustment voltage Vc at this time is stored in adjustment value storage section 109.

Note that adjustment of analog output voltage Va from sensor 98 is performed by setting an automatic toner adjustment mode after the image forming apparatus is installed and is energized for the first time. From the next time when the image forming apparatus is energized, since control voltage Vb is applied to toner sensor 98 on the basis of adjustment value Vc stored in adjustment value storage section 109 in the automatic toner adjustment mode, the automatic toner adjustment mode is not set again.

Figure 12:
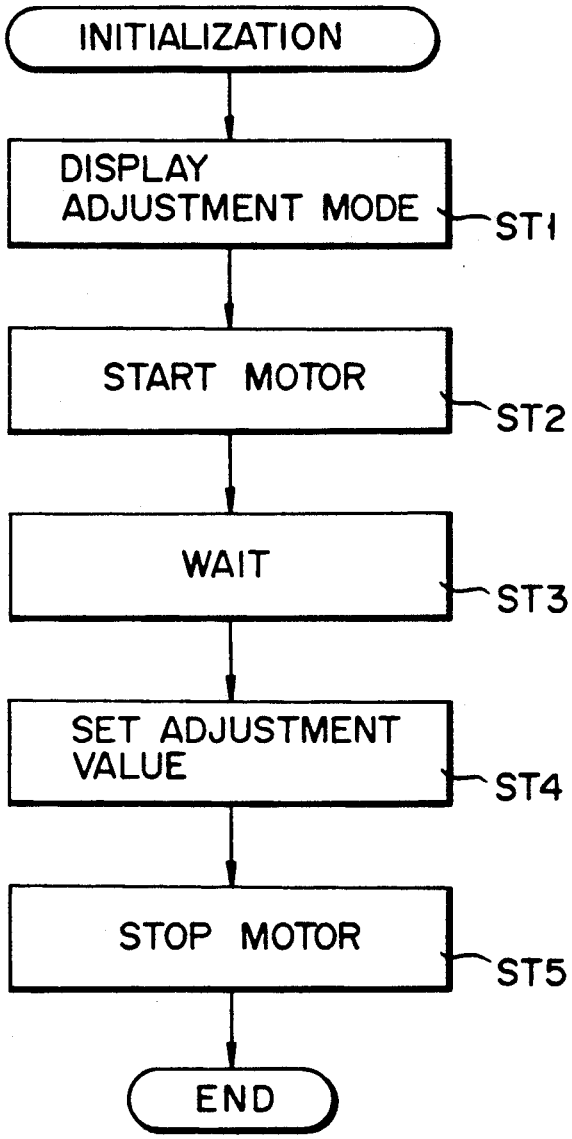
FIG. 12 is a flow chart for explaining an initializing operation of the automatic toner supplier.

An initializing operation in the above-described arrangement will be described below with reference to flow charts shown in FIGS. 12, and FIGS. 13A and 13B.

When, for example, analog output voltage Va from toner sensor 98 is set to an initial value, a power source switch is turned on while "0" and "5" are input through ten-key pad 45 of operation panel 31. As a result, main body 10 of the copying machine is switched from a normal copy mode to an AJ (adjustment) mode. Subsequently, the automatic toner adjustment mode is set by operating copy key 44.

In this case, the selected adjustment mode is displayed on display section 46 in operation panel 31 (step ST1), and developing motor 86 and the like are driven (step ST2). Then, the developing agent in developing unit 23 is agitated by mixer 97 rotated by developing motor 86, and the process is waited until the fluidity of the developing agent is stabilized (step ST3). After this, setting of adjustment value Vc, i.e., adjustment of analog output voltage Va, is started (step ST4).

Figure 13A:
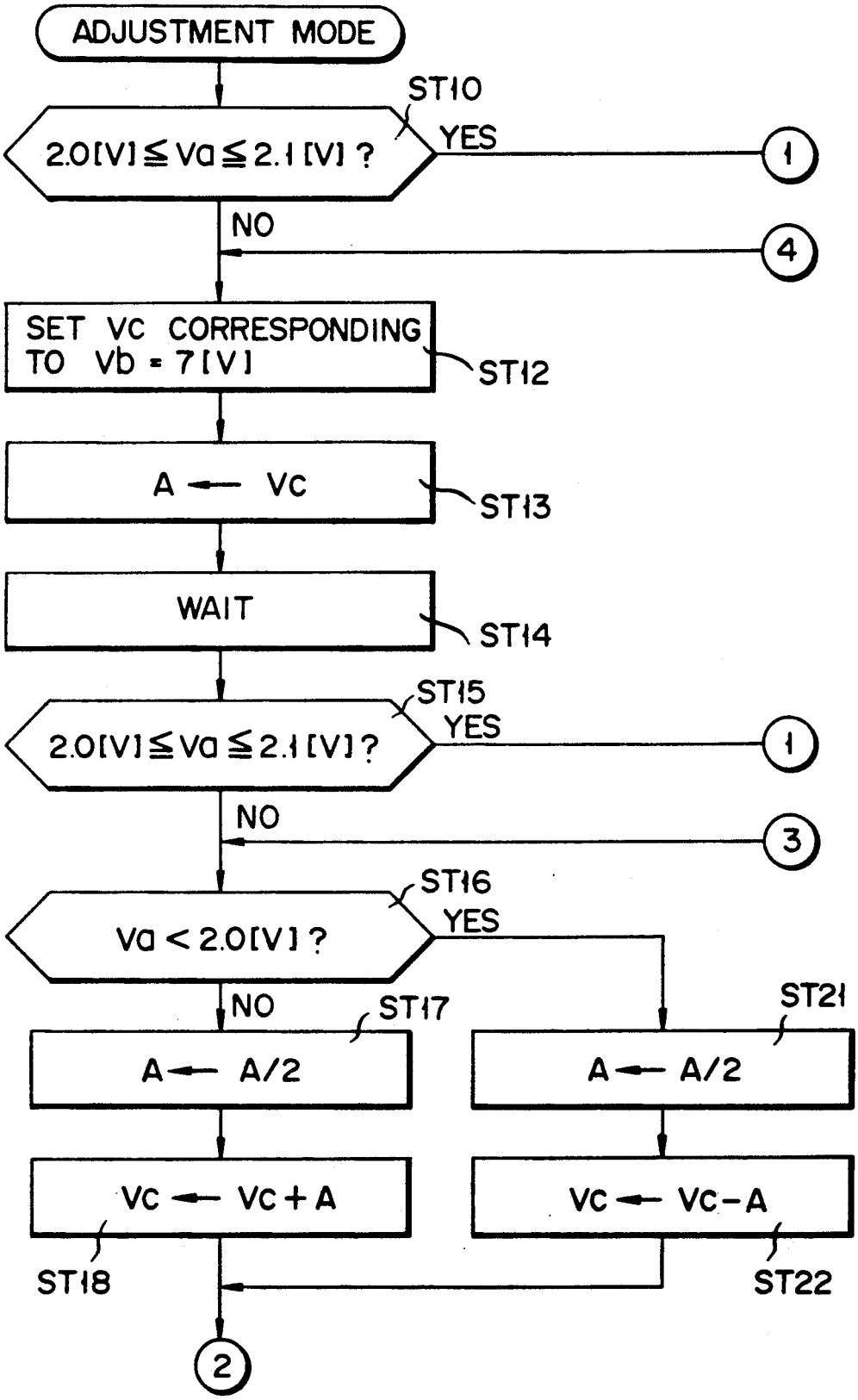
FIGS. 13A and 13B are flow charts for explaining a setting operation of an adjustment value.
Figure 13B:
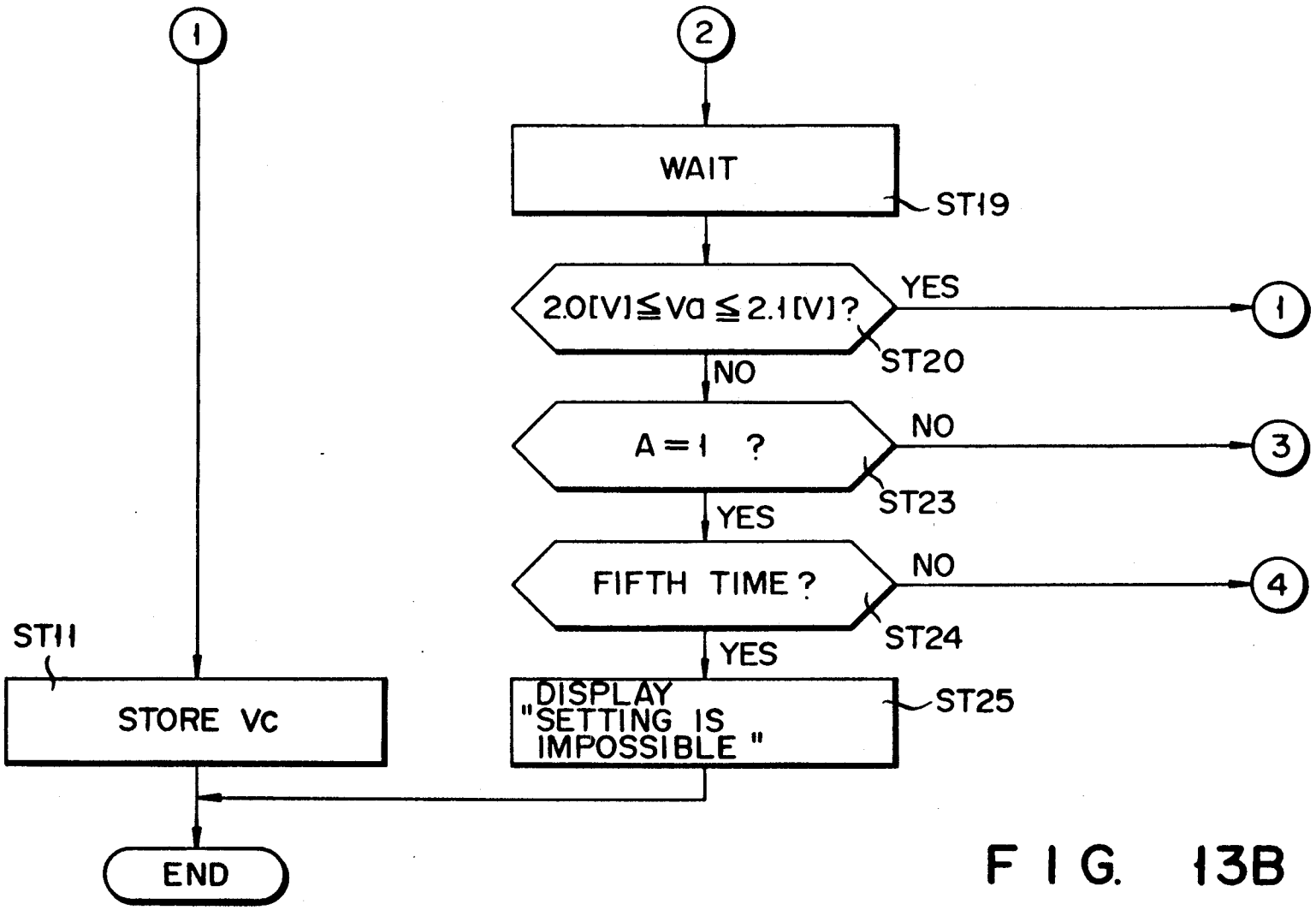

In this step ST4, as shown in a flow chart in FIGS. 13A and 13B, control voltage Vb to be applied to toner sensor 98 is digitally changed by binary search so as to automatically converge output voltages (analog output voltages) from sensor 98 on the reference voltage corresponding to the reference toner density. A case wherein output voltage Va from sensor 98 is adjusted to be 2.0 2.1 volt (the allowable range of the reference voltage) with respect to, e.g., 4% of the reference density of the developing agent will be described.

Output voltage Va from toner sensor 98 is fetched in control section 106, and is converted by internal A/D converter 110 into a digital value. Subsequently, the digital value is compared with the reference voltage read out from reference voltage storage section 111 by comparator 112 (step ST10). If it is determined upon this comparison that output voltage Va falls within the allowable range of the reference voltage ($2.0 \leqq Va \leqq 2.1$), the value of Vc at this time is stored in adjustment value storage section 109 (step ST11), and then the flow advances to step ST5. In step ST5, developing motor 86 is stopped.

If output voltage Va falls outside the allowable range of the reference voltage, ALU 114 sets control voltage Vb at 7 V. With this operation, ALU 114 reads out an adjustment value (fundamental adjustment value) represented by digital value "128" corresponding to control voltage Vb of 7 V from adjustment value table storage section 113, and sets the readout value as adjustment value Vc (step ST12). Adjustment value Vc is stored in register A (not shown) in ALU 114 (step ST13).

Furthermore, control value Vc is converted by D/A converter 107 into control voltage Vb (analog value) of 7 V corresponding to digital value "128" and is applied to toner sensor 98 through amplifier 108. With this operation, output voltage Va from toner sensor 98 is changed.

In this period, the process is delayed by 1 sec (step ST14), and output voltage Va from toner sensor 98 is fed into control circuit 106. After output voltage Va is converted by A/D converter 110 into a digital value, this converted value is compared with the reference voltage by comparator 112 (step ST15). If it is determined upon this comparison that output voltage Va corresponding to control voltage Vb (7 V) of adjustment value Vc (digital value "128") falls within the allowable range of the reference voltage ($2.0 \leqq Va \leqq 2.1$), adjustment value Vc (digital value "128") at this time is stored in adjustment value storage section 109 (step ST11), and the flow is moved to step ST5.

On the other hand, if it is determined upon comparison with the reference voltage that output voltage Va corresponding to control voltage Vb of 7 V falls outside the allowable range of the reference voltage (step ST16), ALU 114 updates the value (digital value "128") stored in register A to ½ the value (digital value "64") (step ST17). Subsequently, a value (digital value "192") obtained by adding the value (digital value "64") stored in register A to adjustment value Vc (digital value "128") is determined to be new adjustment value Vc (step ST18). The new adjustment value Vc is converted by D/A converter 107 into control voltage Vb of 10.5 V corresponding to digital value "192" and is applied to toner sensor 98 through amplifier 108. As a result, output voltage Va from toner sensor 98 is changed.

In this period, the process is delayed by 1 sec (step ST19), and output voltage Va from toner sensor 98 is fed into control circuit 106 again. After output voltage Va is converted by A/D converter 110 into a digital value, the converted value is compared with the reference voltage by comparator 112 (step ST20). If it is determined upon this comparisons that output voltage Va corresponding to control voltage Vb (10.5 V) of adjustment value Vc (digital value "192") falls within the allowable range of the reference voltage ($2.0 \leqq Va \leqq 2.1$), adjustment value Vc (digital value "192") at this time is stored in adjustment value storage section 109 (step ST11), and then the flow returns to step ST5.

If it is determined in step ST16 that output voltage Va corresponding to control voltage Vb of 7 V is higher than the allowable range of the reference voltage, ALU 114 updates the value (digital value "128") stored in register A to ½ the value (digital value "64") (step ST21). Then, a value (digital value "64") obtained by subtracting the value (digital value "64") stored in register A from adjustment value Vc (digital value "64") is set as new adjustment value Vc (step ST22). The new adjustment value Vc is converted by D/A converter 107 into control voltage Vb of 3.5 V corresponding to digital value "64", and is then applied to toner sensor 98 through amplifier 108. With this operation, output voltage Va from toner sensor 98 is changed.

In this period, the process is delayed by 1 sec (step ST19), and output voltage Va from toner sensor 98 is fed into control circuit 106 again. Output voltage Va is converted by A/D converter 110 into a digital value, and is then compared with the reference voltage by comparator 112 (step ST20). If it is determined upon this comparison that output voltage Va corresponding to control voltage Vb (3.5 V) of adjustment value Vc (digital value "64") falls within the allowable range of the reference voltage ($2.0 \leqq Va \leqq 2.1$), adjustment value Vc (digital value "64") at this time is stored in adjustment value storage section 109 (step ST11), and the flow then returns to step ST5.

In contrast to the above case, if it is determined in step ST20 that output voltage Va from toner sensor 98 falls outside the allowable range of the reference voltage, the flow returns to step ST16 to check whether output voltage Va is lower or higher than the allowable range of the reference voltage. If it is determined that voltage Va is lower than the allowable range, ALU 114 updates the contents in register A in the above-described manner in step ST17 (digital value "32"), and the updated value (digital value "32") is added to adjustment value Vc (digital value "192" or "64") at which output voltage Va is determined to be lower than the allowable range in step ST18, thereby setting new adjustment value Vc.

If it is determined that value Va is higher than the allowable range, ALU 114 updates the contents in register A (digital value "32") in step ST21, and the updated value (digital value "32") is subtracted from adjustment value Vc (digital value "192" or "64") at which output voltage Va is determined to be lower than the allowable range, in step ST22, thereby setting new adjustment value Vc.

Subsequently, it is checked again using adjustment value Vc newly set in this manner whether output voltage Va from sensor 98 falls within the allowable range of controlling values which are used for increasing and decreasing operations by repeatedly halving the fundamental value (digital value "128"). More specifically, if it is determined that output voltage Va is lower than the allowable range of the reference voltage, control value Vb to be applied to sensor 98 is digitally changed by using an adjustment value newly obtained by adding values (digital values "64", "32", "16", "8", "4", "2", and "1") which are obtained by repeatedly halving the fundamental adjustment value (digital value "128") to the original adjustment value (the adjustment value corresponding to output voltage Va which is determined to be lower than the reference voltage). If it is determined that output voltage Va is higher than the allowable range of the reference voltage, control voltage Vb is digitally changed by using an adjustment value newly obtained by subtracting values which are obtained by repeatedly halving the fundamental adjustment value from the original adjustment value (the adjustment value corresponding to output voltage Va which is determined to be higher than the allowable range of the reference voltage). With this operation, output voltages Va from sensor 98 are converged on the reference voltage by so-called binary search. Therefore, an analog output voltage during the reference toner density period can be automatically set, and adjustment can be quickly performed with high precision.

Note that if output voltage Va from sensor 98 cannot be set within the allowable range of the reference voltage after changing control voltage Vb through one complete sequence of stages (i.e., seven stages from digital values "64" to "1" described above) (step ST23), steps ST16 to ST23 are repeated five times (step ST24). If it is determined that output voltage Va falls outside the allowable range of the reference voltage (2.0 to 2.1 V) after the above operation, "setting is impossible" is displayed on display section 46 of operation panel 31 (step ST25), and the flow returns to step ST5.

That is, if it is determined that output voltage Va from sensor 98 falls within the allowable range of the reference voltage ($2.0 \leqq Va \leqq 2.1$) (step ST10, ST15, or ST20), or if it is determined that setting is impossible (step ST25), developing motor 86 and the like are stopped (step ST5), and the above-described initializing operation is ended.

As described above, control voltage Vb to be applied to toner sensor 98 is digitally changed by binary search so as to converge its analog output voltages Va on the reference voltage. With this analog output voltage Va during the reference toner density period can be automatically set. Therefore, adjustment of analog output voltage Va from toner sensor 98 can be quickly performed with high precision. This spares an operator from operating a volume or the like, and shortens an adjustment time.

Figure 14:
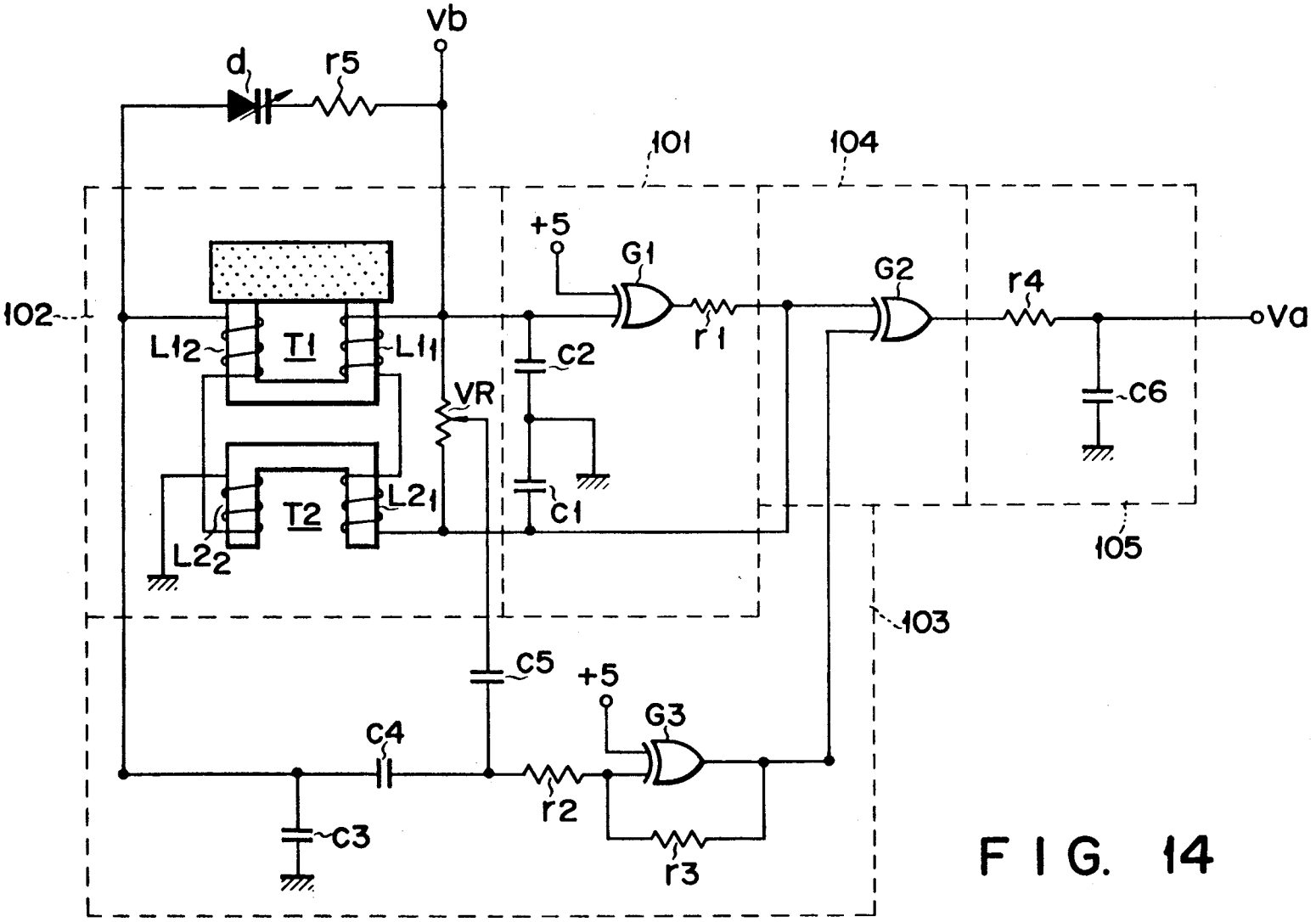
FIG. 14 is a circuit diagram showing an arrangement of the toner sensor.

For example, a sensor having an arrangement shown in FIG. 14 can be used as toner sensor 98. More specifically, magnetic transformers T1 and T2 each having identical multiturn coils wound around a single core are used. Transformer T1 is arranged in a developing agent as a detection side. On the other hand, control voltage Vb to be applied to variable-capacitance diode d is adjusted such that an electromotive force corresponding to the reference toner density of the developing agent is induced in transformer T2 serving as a reference side. The electromotive forces in transformers T1 and T2 are compared with each other so as to detect the density of the developing agent with respect to the reference toner density.

Oscillator 101 is a Colpitts oscillator. The output terminal of exclusive OR gate (to be referred to as an Ex-OR gate hereinafter) G1 in oscillator 101 is connected to one input terminal of Ex-OR circuit G2 constituting phase comparator 104. The output terminal of Ex-OR gate G1 is connected to one end of coil $L2_1$ wound around one end of a substantially U-shaped core constituting magnetic transformer T2 in detection head 102 through resistor r1. The other end of coil $L2_1$ is connected to one end of coil $L1_1$ wound around one end of a substantially U-shaped core constituting magnetic transformer T1. The other end of coil $L1_1$ is connected to one input terminal of Ex-OR gate G1. Variable resistor VR and series-connected capacitors c1 and c2 are connected between the node of resistor r1 and coil $L2_1$, and the one input terminal of Ex-OR gate G1 in parallel. The node between capacitors c1 and c2 is grounded. A power source (+5 V) is connected to the other input terminal of Ex-OR gate G1. Coils $L1_1$ and $L2_1$ are driven by oscillation of Ex-OR gate G1.

Coil $L2_2$ is wound around the other end of the substantially U-shaped core constituting magnetic transformer T2. One end of coil $L2_2$ is grounded, and the other end thereof is connected to one end of coil $L1_2$ wound around the other end of the substantially U-shaped core constituting magnetic transformer T1. Coils $L1_2$ and $L2_2$ are connected to each other such that their electromotive forces are oriented in opposite directions, thereby obtaining a difference between the electromotive forces in the coils. Note that the shapes of coils $L1_1$ and $L1_2$, and coils $L2_1$ and $L2_2$ wound around the respective cores are identical to each other.

The other end of coil $L1_2$ is ground through capacitor c3 and is connected to one input terminal of Ex-OR gate G3 through capacitor c4 and resistor r2. The other input terminal of Ex-OR gate G3 is connected to the power source (+5 V). The output terminal of gate G3 is connected to the other input terminal of Ex-OR gate G2 and is connected to the one input terminal of Ex-OR gate G3 through resistor r3. In addition, the node between capacitor c4 and resistor r2 is connected to the slider member of variable resistor VR through capacitor c5.

The output terminal of Ex-OR gate G2 is connected to one end of resistor r4 constituting integrating circuit 105, whereas the other end of resistor r4 is grounded through capacitor c6 and at the same time is connected to the output terminal of sensor 98.

When coils $L1_1$ and $L2_1$ are driven by oscillation of Ex-OR gate G1, a differential output therebetween is inverted/shaped by Ex-OR gate G3 and is subjected to phase comparison with a driving waveform in Ex-OR gate G2. Thereafter, the differential output is output through integrating circuit 105 as an analog voltage (output voltage Va).

Variable-capacitance diode d used for output adjustment of sensor 98 is connected between coils $L1_1$ and $L1_2$ wound around magnetic transformer T1, as is shown in FIG. 14. With this arrangement, output voltage Va from sensor 98 can be changed by changing control voltage Vb which is applied to variable-capacitance diode d through resistor r5.

Figure 15:
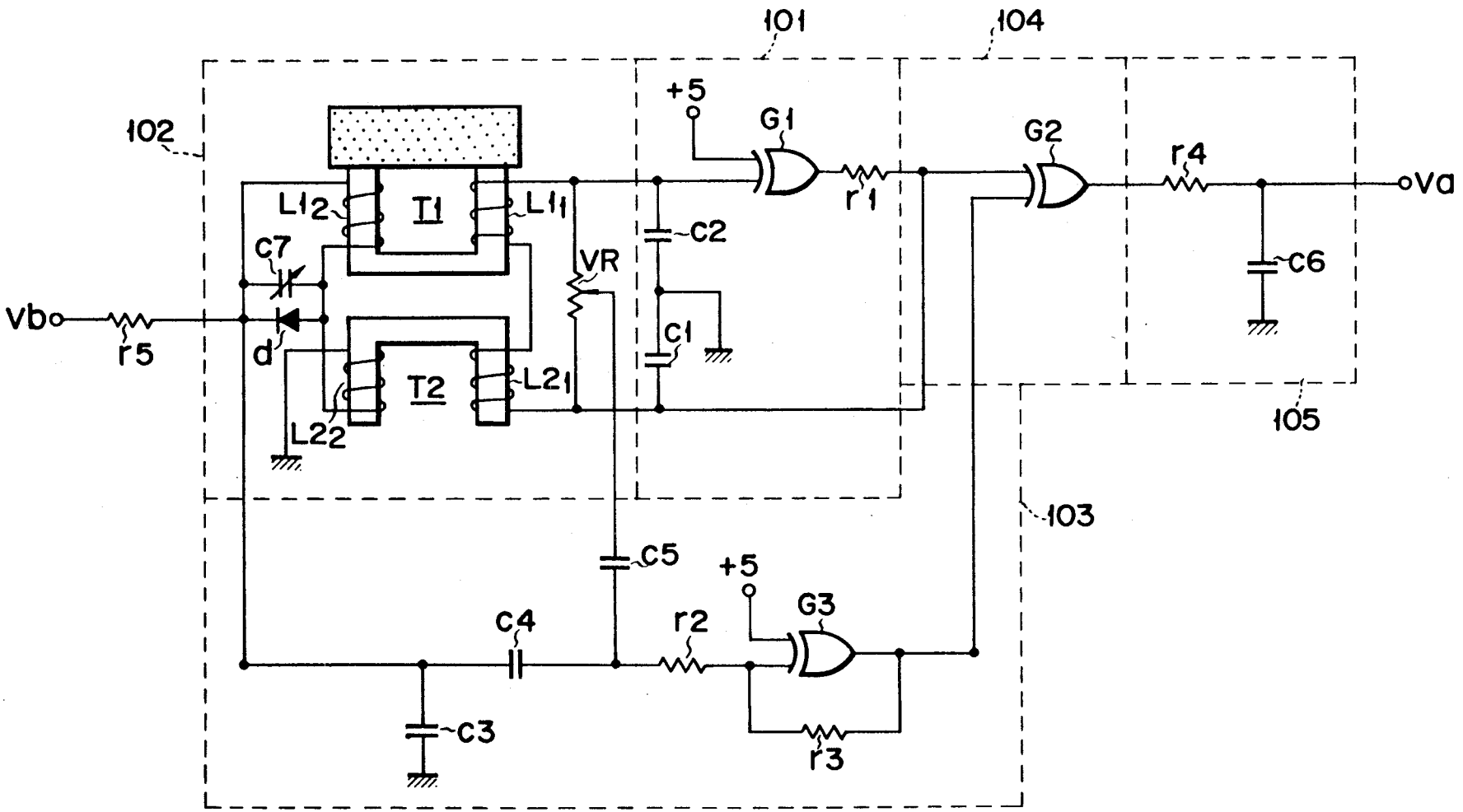
FIG. 15 is a circuit diagram showing another arrangement of the toner sensor.

In addition, a sensor having an arrangement shown in FIG. 15 can be used as toner sensor 98. In toner sensor 98 in FIG. 15, variable capacitor c7 and variable-capacitance diode d are connected in parallel between both the ends of coil $L1_2$ wound around magnetic transformer T1, as is shown in FIG. 15. With this arrangement, output voltage Va from sensor 98 can be changed in accordance with control voltage Vb which is applied through resistor r5.

As described above, toner sensor 98 may have various arrangements. The present invention can be applied to any arrangement of toner sensor 98 as long as it is a sensor capable of changing output voltage Va in accordance with control voltage Vb.

Furthermore, in the above embodiment, an electronic copying machine is exemplified as an image forming apparatus. However, the present invention is not limited to this. For example, the present invention can be applied to a laser beam printer or a microfilm printer comprising a developing unit with an automatic toner supplier.

Moreover, in the above embodiment, the overall control width of control voltage Vb is divided into 256 units. However, adjustment can be performed with higher precision by increasing the number of digital value units dividing the control width or reducing the control width.

Various changes and modifications can be made without departing from the spirit and scope of the invention.

What is claimed is:

1. An image forming apparatus comprising:

means for storing a developing agent which is a mixture of a toner and a carrier;

means for transferring the toner in the developing agent stored in said storing means onto a transfer medium to form an image on the transfer medium;

means for detecting density of the toner in the developing agent stored in said storing means, said detecting means generating an output signal having a level corresponding to the toner density, and including changing means for changing the level of the output signal in proportion to a level of a control signal applied thereto; and initializing means for automatically initializing the output signal from said detecting means by applying the control signal to said changing means of said detecting means, said initializing means including means for converging the control signal on a level such that the output signal from said detecting means is set at a reference level corresponding to a level during periods when the toner density has a reference value, by increasing/decreasing repeatedly the level of the control signal in accordance with the level of the output signal from said detecting means.

2. The apparatus according to claim 1, wherein said initializing means further includes mean for comparing the reference level with the level of the output signal from said detecting means, and said converging means converges the control signal on said level such that the output signal from said detecting means is set at the reference level, in accordance with a comparison result from said comparing means.

3. The apparatus according to claim 2, wherein said converging means converges the control signal on said level, by adding/subtracting a level to/from the level of the control signal in accordance with a comparison result from said comparing means.

4. The apparatus according to claim 3, wherein said converging means includes:

means for storing an initial level of the control signal to be initially set and control means for setting the control signal at the initial level stored in said initial level storage means, sequentially adding/subtracting levels obtained by repeatedly halving the initial level stored in said initial level storage means to/from the level of the control signal in accordance with the comparison result from said comparing means, and outputting levels obtained by the adding/subtracting as the control signal.

5. The apparatus according to claim 4, wherein said control means includes:

means for setting the control signal at the level stored in said initial level storage means;

means for adding a half level obtained by halving the initial level stored in said initial level storage means to the level of the control signal set by said setting means; and control signal storage means for storing a level obtained by said adding means as the control signal.

6. The apparatus according to claim 5, wherein said adding means includes half level adding means for adding a positive half level as the half level to the level of the control signal set by said setting means, when the comparison result from said comparing means represents that the level of the output signal from said detecting means is lower than the reference level, and for adding a negative half level as the half level to the level of the control signal set by said setting means, when the comparison result from said comparing means represents that the level of the output signal from said detecting means is higher than the reference level.

7. The apparatus according to claim 1, wherein said converging means includes means for digitally increasing/decreasing repeatedly the level of the control signal.

8. The apparatus according to claim 1, further comprising:

means for agitating said developing agent; and means for performing said detecting means to detect the toner density after a predetermined period of time has elapsed from a moment that said agitating means stops agitation.

9. An initialization apparatus for automatic toner supplier, said automatic toner supplier comprising: means for storing a toner; means for storing a developing agent which is a mixture of the toner and a carrier; means for detecting the density of the toner in the developing agent stored in said developing agent storing means, said detecting means generating an output signal having a level corresponding to the toner density and changing the level of the output signal in proportion to the level of a control signal applied thereon; and means for automatically supplying the toner from said toner storing means into said developing agent storage means when the output signal from said detecting means indicates the shortage of said toner in said storing means, said initialization apparatus comprising:

means for receiving the output signal from said detecting means when initialization is performed;

means for comparing the level of the output signal from said detecting means, which is received by said receiving means, with a reference level corresponding to a level during periods when the toner density has a reference value;

means for generating the control signal rendering on a level such that the output signal from said detecting means is set at the reference level, by increasing/decreasing repeatedly the level of the control signal in accordance with a comparison result from said comparing means; and means for applying the control signal generated by said control signal generating means to said detecting means.

10. The apparatus according to claim 9, wherein said generating means includes:

means for storing an initial level of the control signal to be initially set;

control means for setting the control signal at the initial level stored in said initial level storage means, sequentially adding/subtracting levels obtained by repeatedly halving the initial level stored in said initial level storage means to/from the level of the control signal in accordance with a comparison result from said comparing means, and outputting levels obtained by the adding/subtracting as the control signal.

11. The apparatus according to claim 10, wherein said control means includes:

means for setting the control signal at the level stored in said initial level storage means;

means for adding a half level obtained by halving the initial level stored in said initial level storage means to the level of the control signal set by said setting means; and control signal storage means for storing a level obtained by said adding means as the control signal.

12. The apparatus according to claim 11, wherein said adding means includes half level adding means for adding a positive half level as the half level to the level of the control signal set by said setting means, when the comparison result from said comparing means represents that the level of the output signal from said detecting means is lower than the reference level, and for adding a negative half level as the half level to the level of the control signal set by said setting means, when the comparison result from said comparing means represents that the level of the output signal from said detecting means is higher than the reference level.

13. The apparatus according to claim 9, wherein said control signal generating means includes means for digitally increasing/decreasing repeatedly the level of the control signal.

14. The apparatus according to claim 9, further comprising:

means for agitating said developing agent; and means for performing said detecting means to detect the toner density after a predetermined period of tim has elapsed from a moment that said agitating means stops agitation.

* * * * *